US010138722B2

(12) United States Patent
Magnuson

(10) Patent No.: US 10,138,722 B2
(45) Date of Patent: Nov. 27, 2018

(54) WELL PROTECTION SYSTEMS AND METHODS

(71) Applicant: Nabors Drilling Technologies USA, Inc., Houston, TX (US)

(72) Inventor: Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 137 days.

(21) Appl. No.: 15/248,220

(22) Filed: Aug. 26, 2016

(65) Prior Publication Data

US 2018/0058187 A1 Mar. 1, 2018

(51) Int. Cl.

| | |
|---|---|
| ***E21B 44/02*** | (2006.01) |
| ***E21B 19/20*** | (2006.01) |
| ***E21B 21/08*** | (2006.01) |
| ***E21B 47/06*** | (2012.01) |
| ***E21B 47/09*** | (2012.01) |

(52) U.S. Cl.

CPC ..... *E21B 44/02* (2013.01); *E21B 19/20* (2013.01); *E21B 21/08* (2013.01); *E21B 47/06* (2013.01); *E21B 47/09* (2013.01)

(58) Field of Classification Search

CPC ..... E21B 44/02; E21B 19/20; E21B 21/08; E21B 47/06

USPC ..... 175/27

See application file for complete search history.

(56) References Cited

U.S. PATENT DOCUMENTS

| | | | | |
|---|---|---|---|---|
| 8,733,472 | B2 | 5/2014 | Magnuson | |
| 9,051,782 | B2 | 6/2015 | Magnuson | |
| 9,354,623 | B2 | 5/2016 | Magnuson | |
| 9,394,751 | B2 | 7/2016 | Magnuson | |
| 2012/0067642 | A1 | 3/2012 | Magnuson | |
| 2013/0292178 | A1* | 11/2013 | Burress | E21B 44/00 175/50 |
| 2014/0202769 | A1 | 7/2014 | Magnuson | |
| 2014/0216815 | A1 | 8/2014 | Magnuson | |
| 2015/0086718 | A1 | 3/2015 | Magnuson et al. | |

(Continued)

OTHER PUBLICATIONS

Cayeux et al. "Automation of Drawworks and Topdrive Management to Minimize Swab/Surge and Poor-Downhole-Condition Effects", 2010 IADC/SPE Drilling Conference and Exhibition, Feb. 2-4, 2010.*

*Primary Examiner* — Taras P Bemko

(74) *Attorney, Agent, or Firm* — Haynes and Boone, LLP

(57) ABSTRACT

The systems, devices, and methods described herein describe a control system that automatically determines a trip speed for a surge operation or a swab operation. The control system is used to automatically adjust the trip speed during the respective surge or swab operation in order to optimize the trip speed according to the changing environment of the wellbore that the bottom hole assembly traverses without exceeding the fracture gradient in the wellbore location. A well plan identifies formations along the wellbore route, dynamic real-time tracking of the tubulars added to the drill string and removed therefrom identifies the current location of the BHA in the wellbore, and pressure and fractional gradient at the location of the BHA, and in some embodiments a real-time pressure measurement from the BHA, together are used to automatically determine the maximum tripping speed possible for the formation that the BHA is traversing.

20 Claims, 9 Drawing Sheets

(56) References Cited

U.S. PATENT DOCUMENTS

| | | | | |
|---|---|---|---|---|
| 2015/0090463 | A1 | 4/2015 | Gupta et al. | |
| 2015/0096764 | A1 | 4/2015 | Magnuson et al. | |
| 2015/0101826 | A1 | 4/2015 | Gupta et al. | |
| 2015/0142318 | A1* | 5/2015 | Hildebrand | E21B 44/06 702/9 |
| 2015/0232272 | A1 | 8/2015 | Magnuson | |
| 2015/0330162 | A1 | 11/2015 | Magnuson et al. | |
| 2016/0060979 | A1 | 3/2016 | Magnuson | |
| 2016/0060980 | A1 | 3/2016 | Magnuson | |
| 2016/0168928 | A1 | 6/2016 | Magnuson | |
| 2016/0168929 | A1 | 6/2016 | Magnuson et al. | |
| 2016/0251869 | A1 | 9/2016 | Deel et al. | |
| 2016/0319610 | A1 | 11/2016 | Magnuson | |

* cited by examiner

WELL PROTECTION SYSTEMS AND METHODS

TECHNICAL FIELD

The present disclosure is directed to systems, devices, and methods for controlling the speed used to trip a drill string into and out of a wellbore. More specifically, the present disclosure is directed to systems, devices, and methods for dynamically and automatically determining a speed at which to trip a drill string in a wellbore based on one or more received inputs and a determined or estimated condition of the wellbore.

BACKGROUND OF THE DISCLOSURE

Underground drilling involves drilling a bore through a formation deep in the Earth using a drill bit connected to a drill string. During drilling, occasionally the drill string needs to be removed from the wellbore, for example to run casing and cementing in the wellbore to ensure the stability of the wellbore. This removal from the wellbore may also be referred to as tripping out of the wellbore. After running casing and cementing, it may be desirable to resume drilling in which case the drill string is inserted back into the wellbore. This insertion may also be referred to tripping in the wellbore. For example, upon reaching the specific depth for which casing is to be run, tripping out of the wellbore begins. This includes the drawworks (or similar) hoisting the drill string out of the hole of the wellbore so that the stands of drill pipe can be removed and placed on a setback.

Currently, drawworks operations are governed by the estimated stability of the wellbore in an open hole (i.e., a wellbore where casing has not been run yet, but the wellbore depth has been drilled). Rapid movement of tubulars into and out of the wellbore results in surge or swab, respectively, pressure effects on the wellbore. For example, when tripping out of the wellbore, the movement of the drill string causes a fluctuation in pressure in the wellbore that includes a decrease of drilling fluid pressure at the bottom of the wellbore. This is caused by the friction between the movement of the drill string and the stationary drilling fluid (e.g., drilling mud). This may be referred to as a swab pressure $P_{SW}$. As another example, when tripping into the wellbore, the movement of the drill string causes an increase in pressure due to the drill string movement, and may be referred to as surge pressure $P_{SURGE}$.

Rapid movement of the drill string in an open hole, however, can cause unsafe conditions. For example, the rapid movement could result in formation fracturing, sluffing, and a release of wellbore gases. As a result of this concern, typically a hoisting or lowering speed of the drawworks is limited to prevent the unsafe conditions, and be based on the limitations imposed by the open hole condition. Further, the maximum tripping speed for hoisting or lowering is provided based on human calculation. The present disclosure is directed to systems, devices, and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
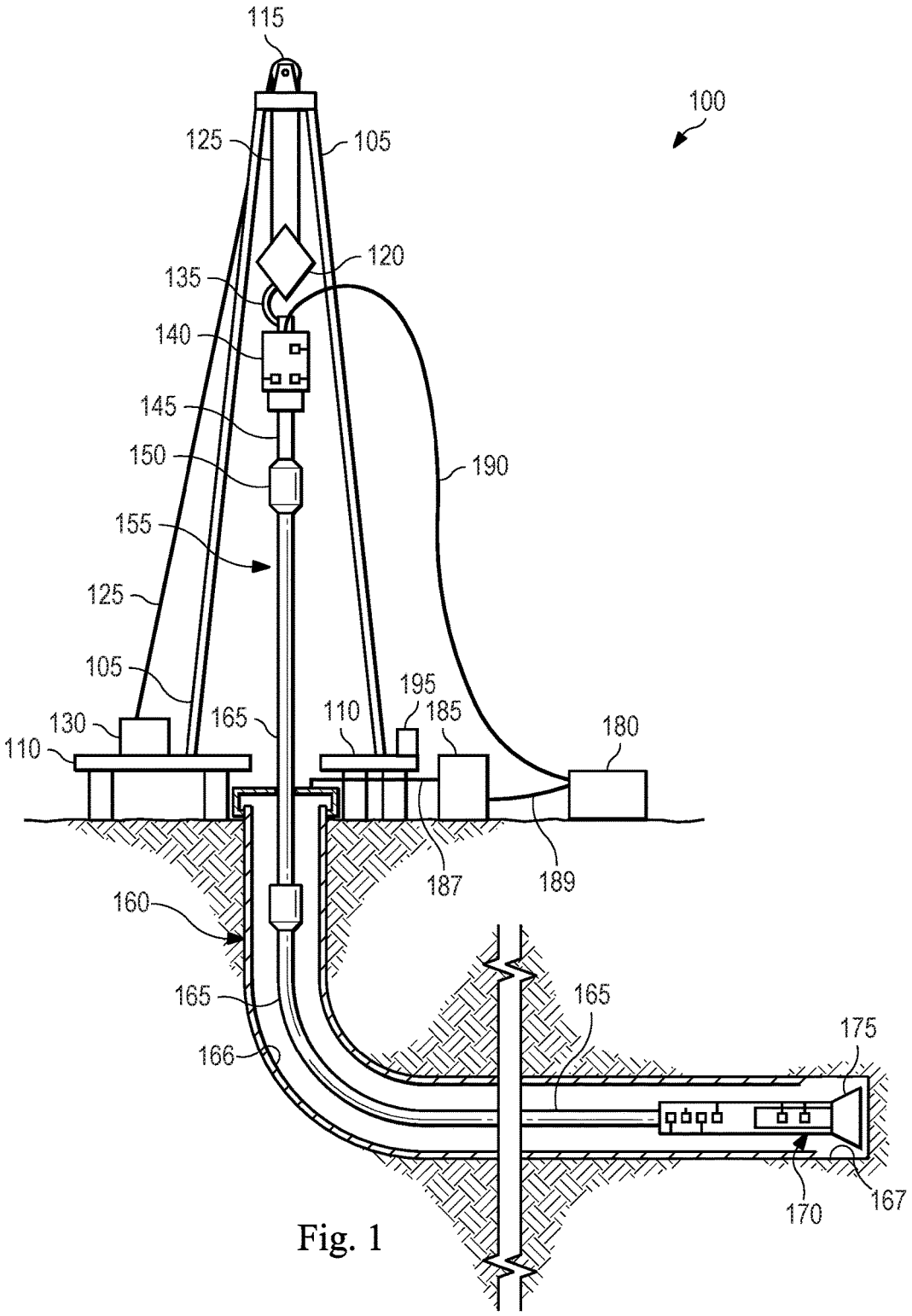
FIG. 1 is a schematic of an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Embodiments of the present disclosure describe a drilling rig apparatus that includes a control system that automatically determines a trip speed for a surge operation or a swab operation. The control system is used to automatically adjust the trip speed during the respective surge or swab operation in order to optimize the trip speed according to the changing environment of the wellbore that the bottom hole assembly traverses, all while protecting against the unsafe conditions identified above, including formation fracturing, sluffing, and an undesired release of wellbore gases.

Embodiments of the present disclosure utilize the well plan provided to the system, dynamic real-time tracking of the tubulars added to the drill string and removed therefrom to determine the current location of the bottom hole assembly in the wellbore, pressure gradient and fractional gradient of the wellbore at the location of the bottom hole assembly, and in some embodiments a real-time pressure measurement from the bottom hole assembly to determine the maximum tripping speed (swab speed in a swab operation or surge speed in a surge operation) possible for the present formation that the bottom hole assembly is traversing.

For example, the control system receives the well plan, such as prior to drilling beginning. During drilling, the bottom hole assembly may include an x-ray sensor that validates the formations identified in the well plan and, where appropriate, updates the data of the well plan according to any discrepancies identified. With the well plan data, gradient data, and tracked depth of the bottom hole assembly, the control system in an embodiment may identify the maximum trip speed, whether surge speed or swab speed, for each region of the wellbore. The regions may be identified according to whether they are in casing or their type of geological formation. These maximum trip speeds (per formation/casing region) may be stored for subsequent access. As another example, the control system may receive pressure data after a tripping operation begins and may compute the maximum trip speed therefore in a short feedback loop such that the control system adapts the trip speed to the surrounding wellbore environment in real-time.

For example, when a swab operation begins, the control system may determine (or have previously determined) the maximum swab speed possible given the existing formation in which the bottom hole assembly is located. As the swab occurs, the control system may continue monitoring the location based on the tracking of the tubulars (e.g., as they are removed the system is updated) and, when the bottom hole assembly reaches a different formation (or some threshold range near the transition) the control system may cause a drawworks of the system to adjust the swab speed according to the new formation region. For example, if the bottom hole assembly was in a formation that was relatively stable and the wellbore was open hole at that point, the swab speed may be greater than in the adjacent formation that the bottom hole assembly reaches that is less stable.

As the transition to the less stable formation occurs, the control system decreases the swab speed. When the next transition to the next formation occurs, for example from open hole to casing, the control system may again adjust the swab speed to increase. In this manner, the control system is able to automatically adjust the swab speed to accommodate the changing environment in the wellbore that the bottom hole assembly is traversing and therefore increase the efficiency and safety of the swab operation. A surge operation may occur in similar manner—tracking the location of the bottom hole assembly during the surge movement, adjust the surge speed up or down as different formations are reached (which may include a transition from casing to open hole), and continue monitoring/adjusting until the surge operation completes.

FIG. 1 is a schematic of a side view of an exemplary drilling rig 100 according to one or more aspects of the present disclosure. In some examples, the drilling rig 100 may form a part of a land-based, mobile drilling rig. However, one or more aspects of the present disclosure are applicable or readily adaptable to any type of drilling rig with supporting drilling elements, for example, the rig may include any of jack-up rigs, semisubmersibles, drill ships, coil tubing rigs, well service rigs adapted for drilling and/or re-entry operations, and casing drilling rigs, among others within the scope of the present disclosure.

The drilling rig 100 includes a mast 105 supporting lifting gear above a rig floor 110. The lifting gear may include a crown block 115 and a traveling block 120. The crown block 115 is coupled at or near the top of the mast 105, and the traveling block 120 hangs from the crown block 115 by a drilling line 125. One end of the drilling line 125 extends from the lifting gear to axial drive 130. In an embodiment, axial drive 130 is a drawworks, which is configured to reel out and reel in the drilling line 125 to cause the traveling block 120 to be lowered and raised relative to the rig floor 110 (i.e., parallel to a vertical axis of the drilling rig 100, and hence reference to it as an "axial drive"). The other end of the drilling line 125, known as a dead line anchor, is anchored to a fixed position, possibly near the drawworks 130 or elsewhere on the rig. Other types of hoisting/lowering mechanisms may be used as axial drive 130 (e.g., rack and pinion traveling blocks as just one example), though in the following reference will be made to drawworks 130 for ease of illustration.

A hook 135 is attached to the bottom of the traveling block 120. A drill string rotary device 140, of which a top drive is an example, is suspended from the hook 135. Reference will be made herein simply to top drive 140 for simplicity of discussion. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." It should be understood that other techniques for arranging a rig may not require a drilling line, and are included in the scope of this disclosure.

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. The drill bit 175 is connected to the bottom of the BHA 170 or is otherwise attached to the drill string 155. In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others. The drill string 155 in the wellbore 160 may extend through both regions having casing 166 as well as those in open hole, or portions of the wellbore 160 that does not have casing and cement installed yet, illustrated as open hole portion 167 in FIG. 1.

A mud pump system 180 receives the drilling fluid, or mud, from a mud tank assembly 185 and delivers the mud to the drill string 155 through a hose or other conduit 190, which may be fluidically and/or actually connected to the top drive 140. In an embodiment, the mud may have a density of at least 9 pounds per gallon. As more mud is pushed through the drill string 155, the mud flows through the drill bit 175 and fills the annulus that is formed between the drill string 155 and the inside of the wellbore 160, and is pushed to the surface. At the surface the mud tank assembly 185 recovers the mud from the annulus via a conduit 187 and separates out the cuttings. The mud tank assembly 185 may include a boiler, a mud mixer, a mud elevator, and mud storage tanks. After cleaning the mud, the mud is transferred from the mud tank assembly 185 to the mud pump system 180 via a conduit 189 or plurality of conduits 189. When the circulation of the mud is no longer needed, the mud pump system 180 may be removed from the drill site and transferred to another drill site.

The apparatus 100 also includes a control system 195 configured to control or assist in the control of one or more components of the apparatus 100. For example, the control system 195 may be configured to transmit operational control signals to the drawworks 130, the top drive 140, the BHA 170 and/or the pump 180. The control system 195 may be a stand-alone component installed somewhere on or near the drilling rig 100, e.g. near the mast 105 and/or other components of the drilling rig 100. In some embodiments, the control system 195 is physically displaced at a location separate and apart from the drilling rig.

According to embodiments of the present disclosure, the control system 195 may be a wellbore protection control system or include the wellbore protection control system (e.g., among other control systems of the drilling rig 100). The control system 195 may further include an asset tracking system that tracks every tubular used in the drill string, for example as described in U.S. application Ser. No. 14/184,771, filed on Feb. 20, 2014, which is incorporated by reference herein in its entirety. Thus, as a tubular is added to the drawstring 155 or removed from the draw string 155, it may be scanned (e.g., using a barcode or other indicia on the tubular) to identify the tubular and its location.

The control system 195 may receive multiple inputs, including data from a wellbore plan for the wellbore 160 (e.g., at a time previous to a trip out or in to the wellbore 160), tracking data for the tubulars, and measurement data from sensors located throughout the system, including from the drawworks 130, top drive 140, and BHA 170 such as will be discussed further below. With the received data, the control system 195 may track a location of the drill bit 175 in the wellbore 160, the estimated and/or actual environmental condition of the wellbore at the depth of the drill bit 175 (e.g., stable formation or unstable formation), and calculate the maximum trip speed appropriate for the conditions of the wellbore 160 at the location of the drill bit 175 so as to account for surge/swab pressure effects during tripping. With this information, for example, the control system 195 may dynamically modulate the trip speed during a swab operation (tripping out of the wellbore 160) or a surge operation (tripping into the wellbore 160) to accommodate the local condition of the wellbore (e.g., increasing the trip speed when in a stable formation/in a portion of the wellbore 160 that has casing 166, or decreasing the trip speed when in an unstable formation portion of the wellbore 160 in open hole portion 167).

Figure 2:
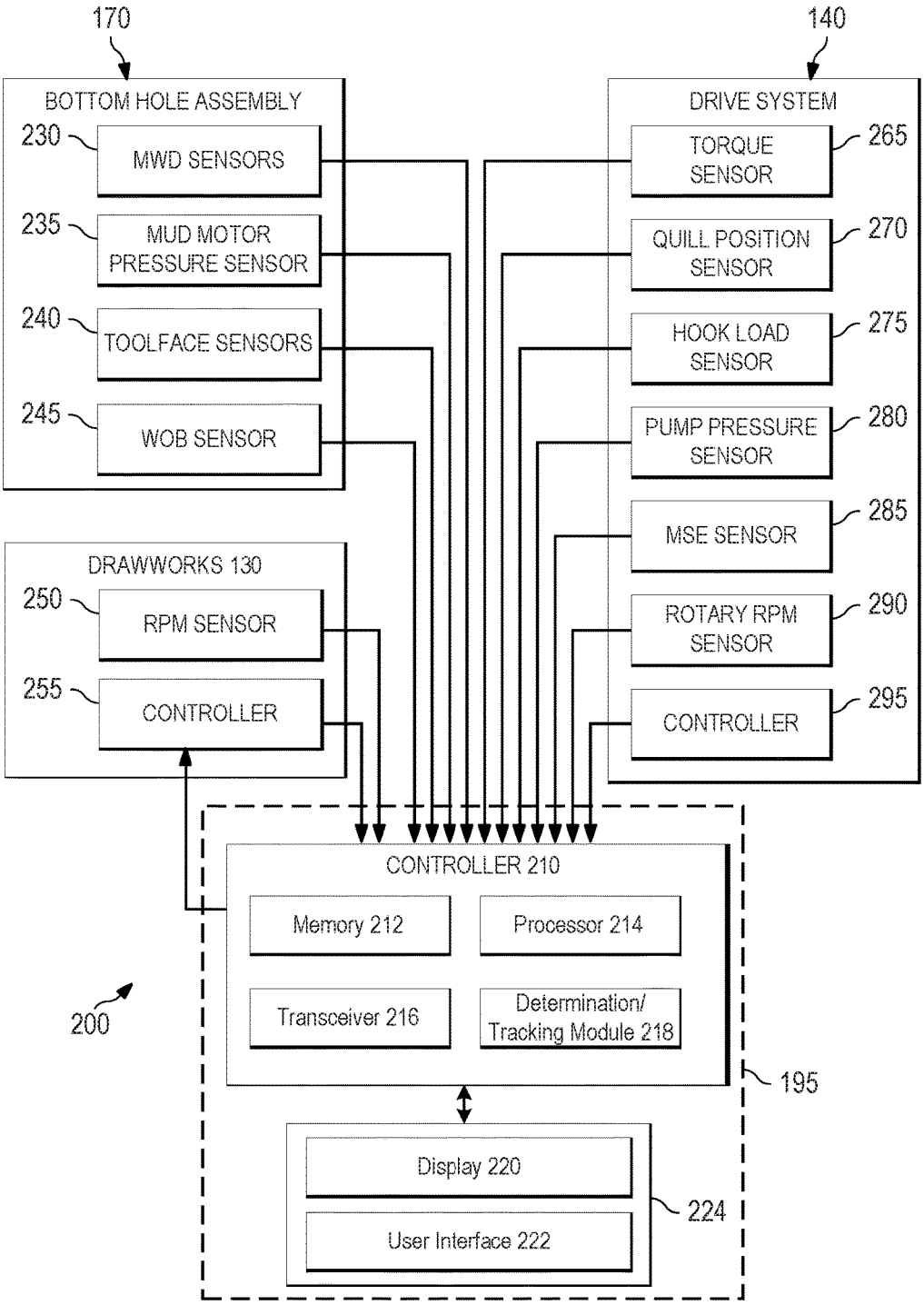
FIG. 2 is a block diagram of an exemplary wellbore protection control system according to one or more aspects of the present disclosure.

Turning to FIG. 2, a block diagram of an exemplary wellbore protection control system according to one or more aspects of the present disclosure is illustrated. In an embodiment, the control system 200 may be described with respect to the drawworks 130, top drive 140, BHA 170, and control system 195. The control system 200 may be implemented within the environment and/or the apparatus shown in FIG. 1.

The control system 195 includes a controller 210 and a user interface 224. Depending on the embodiment, these may be discrete components that are interconnected via wired or wireless means. Alternatively, the user interface 224 and the controller 210 may be integral components of a single system.

The controller 210 includes a memory 212, a processor 214, a transceiver 216, and a determination/tracking module 218. Although illustrated as combined, the controller 210 may separately perform asset tracking (e.g., tubular tracking) and trip speed maintenance. Alternatively, separate controllers may be used for tracking and trip speed maintenance and be in communication with each other. The memory 212 may include a cache memory (e.g., a cache memory of the processor 214), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory 212 may include a non-transitory computer-readable medium. The memory 212 may store instructions. The instructions may include instructions that, when executed by the processor 214, cause the processor 214 to perform operations described herein with reference to the controller 210 in connection with embodiments of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor 214 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the controller 210 introduced in FIG. 1 above. The processor 214 may also be implemented as a combination of computing devices, e.g., a combination of a DSP and a microprocessor, a plurality of microprocessors, one or more microprocessors in conjunction with a DSP core, or any other such configuration. The transceiver 216 may include a local area network (LAN), wide area network (WAN), Internet, satellite-link, and/or radio interface to communicate bi-directionally with other devices, such as the drive system 140, drawworks 130, BHA 170, and other networked elements.

The control system 195 also includes an interface system 224. The interface system 224 includes a display 220 and a user interface 222. The interface system 224 also includes a memory and a processor as described above with respect to controller 210. In an embodiment, the interface system 224 is separate from the controller 210, while in another embodiment the interface system 224 is part of the controller 210.

The display 220 may be used for visually presenting information to the user in textual, graphic, or video form. The display 220 may also be utilized by the user to input drilling parameters, limits, or set point data in conjunction with the input mechanism of the user interface 222. For example, the input mechanism may be integral to or otherwise communicably coupled with the display 220. The input mechanism of the user interface 222 may also be used to input additional settings or parameters. The user interface 222 may be used to receive the well plan and/or drill setting data before and/or during drilling operations.

The input mechanism of the user interface 222 may include a keypad, voice-recognition apparatus, dial, button, switch, slide selector, toggle, joystick, mouse, data base and/or other conventional or future-developed data input device. Such a user interface may support data input from local and/or remote locations. Alternatively, or additionally, the user interface may permit user-selection of predetermined profiles, algorithms, set point values or ranges, and well plan profiles/data, such as via one or more drop-down menus. The data may also or alternatively be selected by the controller 210 via the execution of one or more database look-up procedures. In general, the user interface 222 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The top drive 140 includes one or more sensors or detectors. The top drive 140 includes a rotary torque sensor 265 that is configured to detect a value or range of the reactive torsion of the quill 145 or drill string 155. For example, the torque sensor 265 may be a torque sub physically located between the top drive 140 and the drill string 155. As another example, the torque sensor 265 may additionally or alternative be configured to detect a value or range of torque output by the top drive 140 (or commanded to be output by the top drive 140), and derive the torque at the drill string 155 based on that measurement. The detected voltage and/or current may be used to derive the torque at the interface of the drill string 155 and the top drive 140. The controller 295 is used to control the rotational position, speed and direction of the quill 145 or other drill string component coupled to the top drive 140 (such as the quill 145 shown in FIG. 1), shown in FIG. 2.

The top drive 140 may also include a quill position sensor 270 that is configured to detect a value or range of the rotational position of the quill, such as relative to true north or another stationary reference. The rotary torque and quill position data detected via sensors 265 and 270, respectively, may be sent via electronic signal or other signal to the controller 210 via wired or wireless transmission (e.g., to the transceiver 216). The top drive 140 may also include a hook load sensor 275, a pump pressure sensor or gauge 280, a mechanical specific energy (MSE) sensor 285, and a rotary RPM sensor 290.

The hook load sensor 275 detects the load on the hook 135 as it suspends the top drive 140 and the drill string 155. The hook load detected via the hook load sensor 275 may be sent via electronic signal or other signal to the controller 210 via wired or wireless transmission. The pump pressure sensor or gauge 280 is configured to detect the pressure of the pump providing mud or otherwise powering the down-hole motor in the BHA 170 from the surface. The pump pressure detected by the pump sensor pressure or gauge 280 may be sent via electronic signal or other signal to the controller 210 via wired or wireless transmission. The MSE sensor 285 is configured to detect the MSE representing the amount of energy required per unit volume of drilled rock. In some embodiments, the MSE is not directly sensed, but is calculated based on sensed data at the controller 210 or other controller about the apparatus 100. The rotary RPM sensor 290 is configured to detect the rotary RPM of the drill string 155. This may be measured at the top drive or elsewhere, such as at surface portion of the drill string 155. The RPM detected by the RPM sensor 290 may be sent via electronic signal or other signal to the controller 210 via wired or wireless transmission.

The drawworks 130 may include one or more sensors or detectors that provide information to the controller 210. The drawworks 130 may include an RPM sensor 250. The RPM sensor 250 is configured to detect the rotary RPM of the drilling line 125, which corresponds to the speed of hoisting/lowering of the drill string 155. This may be measured at the drawworks 130. The RPM detected by the RPM sensor 250 may be sent via electronic signal or other signal to the controller 210 via wired or wireless transmission. The drawworks 130 may also include a controller 255. The controller 255 is used to control the speed at which the drawstring is hoisted or lowered.

In addition to the top drive 140 and drawworks 130, the BHA 170 may include one or more sensors, typically a plurality of sensors, located and configured about the BHA 170 to detect parameters relating to the drilling environment, the BHA 170 condition and orientation, and other information. These may provide information that is considered by the controller 210 when it determines the trip speed for a swab or surge operation so as to take into account the types of formations the drill bit 175 is traveling through at a point in time, which may result in modulating the trip speed if the wellbore environment varies over distance (e.g., passing through different formations with different properties and/or portions of the wellbore 160 with casing 166 or portions of open hole 167).

In the embodiment shown in FIG. 2, the BHA 170 includes MWD sensors 230. For example, the MWD sensor 230 may include a MWD casing pressure sensor that is configured to detect an annular pressure value or range at or near the MWD portion of the BHA 170. The casing pressure data detected via the MWD casing pressure sensor may be sent via electronic signal or other signal to the controller 210 via wired or wireless transmission. The MWD sensors 230 may also include an MWD shock/vibration sensor that is configured to detect shock and/or vibration in the MWD portion of the BHA 170. The MWD sensors 230 may also include an MWD torque sensor that is configured to detect a value or range of values for torque applied to the bit by the motor(s) of the BHA 170. The MWD sensors 230 may also include an MWD RPM sensor that is configured to detect the RPM of the bit of the BHA 170. The data from these sensors may be sent via electronic signal or other signal to the controller 210 as well via wired or wireless transmission.

The MWD sensors 230 may further include an x-ray sensor (or a gamma ray sensor) that may be a short-range, highly-focused scattering sensor. The sensor may detect gamma rays arising from the formation being drilled, or alternatively may produce rays and detect the scattered results (where an x-ray lithography sensor). The data from the x-ray sensor may similarly be sent to the controller 210 via electronic or other signal via wired or wireless transmission. The controller 210 may use this data in verifying the formations against what is recorded in the well plan, as discussed further below.

The BHA 170 may also include mud motor ΔP (differential pressure) sensor 235 that is configured to detect a pressure differential value or range across the mud motor of the BHA 170. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque. The BHA 170 may also include one or more toolface sensors 240. The one or more toolface sensors 240 may include a magnetic toolface sensor and a gravity toolface sensor that are cooperatively configured to detect the current toolface orientation, such as relative to magnetic north. The gravity toolface may detect toolface orientation relative to the Earth's gravitational field. In an exemplary embodiment, the magnetic toolface sensor may detect the current toolface when the end of the wellbore is less than about 7° from vertical, and the gravity toolface sensor may detect the current toolface when the end of the wellbore is greater than about 7° from vertical. The BHA 170 may also include an MWD weight-on-bit (WOB) sensor 245 that is configured to detect a value or range of values for down-hole WOB at or near the BHA 170. The data from these sensors may be sent via electronic signal or other signal to the controller 210 via wired or wireless transmission.

Returning to the controller 210, the determination/tracking module 218 may be used for various aspects of the present disclosure. The determination/tracking module 218 may include various hardware components and/or software components to implement the aspects of the present disclosure. For example, in an embodiment the determination/tracking module 218 may include instructions stored in the memory 212 that causes the processor 214 to perform the operations described herein. In an alternative embodiment, the determination/tracking module 218 is a hardware module that interacts with the other components of the controller 210 to perform the operations described herein.

As discussed above, the module 218 may be used for asset (e.g., tubular) tracking that tracks every tubular used in the drill string. This tracking may include various data points, including prior use of each tubular, specification (e.g., outside diameter and collar diameter, material properties, etc.) information, range, length, inspection history, service and repair history, well history, etc. Thus, as a tubular is added to the top of the drill string 155, for example as part of a drilling operation or during a surge operation (e.g., to resume drilling), when the tubular is scanned at the wellbore its data may be received by the controller 210, and the determination/tracking module 218 may update a database regarding the tubular (e.g., for usage statistics/wear tracking). Further, the determination/tracking module 218 may add data to an ongoing record regarding the change in length to the drill string 155 by addition of the length of the new tubular. This length is then used to track the depth of the drill bit 175 in the wellbore 160.

The module 218 is also used for determining trip speed dynamically during a surge or swab operation. In an embodiment, the module 218 causes the processor 214 to perform calculations to determine various wellbore characteristics and variables used in determining the trip speed, as well as a trip speed itself. For example, a pressure gradient (i.e., the change in pressure in the wellbore 160 as depth increases) may be determined for the wellbore 160 as well as a fracture gradient (i.e., a pressure gradient at which a particular formation breaks down to accept fluid in a wellbore 160) for each of the predicted and/or measured formations that the wellbore 160 passes through. In an embodiment, the pressure gradient is maintained as less than the fracture gradient. Another example is laminar flow, which the module 218 may determine to assist in computing the trip speed for the surge or swab operation. Another example is turbulent flow that may be used with respect to the performance of the mud used in the drilling operation.

In an embodiment, the module 218 may determine the trip speed for the surge or swab operation based on the predicted (and, in some embodiments, verified according to data from the x-ray sensor at the BHA 170 where included and used) parameters from the well plan, the tracking data from the tracking of the tubulars of the drill string 155, and calculated pressure gradient and fracture gradient information identified above. Well plan data can include such information as geography information, hazard information, water depth, conductor pipe depth, casing sections by measured depth and total vertical depth, location of casing hangers, BHA and hole size by casing sections, drill pipe size (outside diameter both along pipe and at collars), mud weight by section of the proposed wellbore 160, kickoff location, deviation angle including a target measured depth and total vertical depth, inclination, azimuth, cementing requirements, hydraulic and rotary torque requirements, and expected temperature and pressure in the wellbore environment. The well plan data can include any or all of the above aspects.

With the well plan information and pressure gradient/fracture gradient information, the module 218 may determine the maximum surge and/or swab speeds for every range of depth along the drill string 155. For example, the module 218 may access the well plan information and, for each identified formation predicted or known in the well plan, compute a swab speed and a surge speed (each an example of a trip speed) to be used in setting the RPMs for the drawworks 130 so as to attain that trip speed. The module 218 may also identify a boundary at which the trip speed should transition from one value to another, e.g. corresponding to a boundary predicted along the wellbore 160 from one formation type to another (including a transition from casing 166 to open hole 167 or vice versa). In an unstable formation, such as a soft, weak, or permeable stone, the resulting trip speed will likely be a lower value so as to preserve well integrity during a surge operation or a swab operation, while in a stable formation such as where casing 166 is installed or a hard, impermeable, or otherwise strong stone the resulting trip speed will likely be a larger value than otherwise obtainable from the "worst case scenario" open hole condition.

The module 218 may determine the maximum trip speeds for every region along the wellbore 160 that the BHA 170 would be traveling during the trip out of or into the wellbore 160. These surge speed and swab speed values may be determined beforehand and stored in a database that is accessed during operation. Alternatively, the trip speeds may be determined while the surge or swab operation is underway.

In an alternative embodiment, the module 218 may determine the trip speed for the surge or swab operation based on measured parameters from the wellbore 160, predicted (and verified where used) parameters from the well plan, and the tracking data from the tracking of the tubulars of the drill string 155. For example, in embodiments where a pressure sensor is included at the BHA 170 at the distal end of the drill string 155, pressure data may be sent back to the controller 210 for use by the module 218, as opposed to relying upon the predicted pressure gradients. Thus, as pressure data is received, it is incorporated and used in calculating the maximum trip speed for the formation that the drill bit 175 is currently traversing.

In another alternative embodiment, the module 218 may determine the maximum trip speeds for each formation beforehand (for surge and/or swab operations), store that data, and update the maximum speeds for a given operation based on pressure data sensed during the operation—e.g., during a surge operation, set the surge speed according to the previously calculated speed for the given formation that the drill bit 175 is currently traversing, as well as calculate the surge speed based on the measured pressure results. The two values may be compared in real time as the surge operation is underway, and if there is a difference between the two, update the speed to reflect the current pressure measurements from the wellbore 160. A similar approach may be undertaken during a swab operation.

There are numerous models that have been developed for predicting pressure as the result of swab and surge when downhole sensors are not available. These models may uses as a minimum: hole diameter, drill pipe & drill collar diameters, fraction gradient, laminar flow, and turbulent flow in order to calculate the increased pressure as a result of fluid passing around tubulars as they are hoisted or lowered into the wellbore. The resulting pressure can be attributed to the hoist or lowering speed of the drill string and the resultant pressure. Utilizing these models, speed limits are developed to reduce the pressure that may act on the wellbore.

Figure 3:
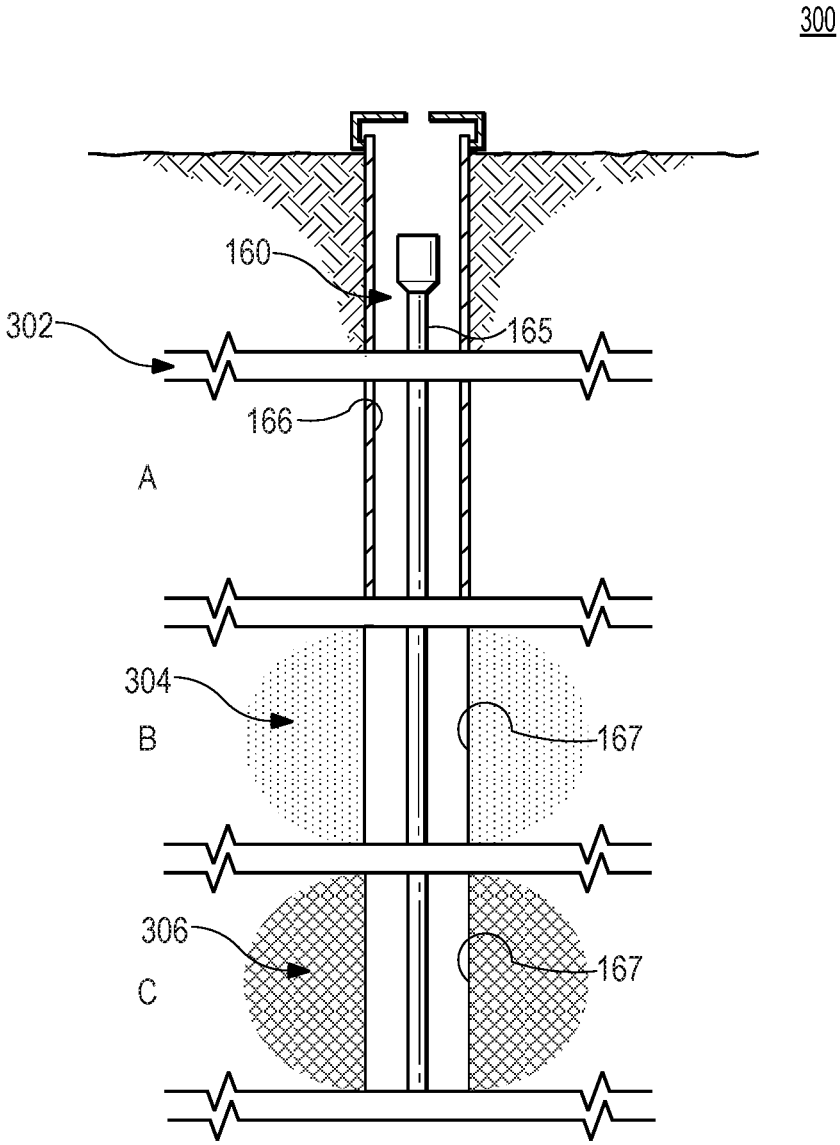
FIG. 3 is a cross-section view of an exemplary wellbore environment according to one or more aspects of the present disclosure.

Turning now to FIG. 3, a cross-section view of an exemplary wellbore environment 300 according to one or more aspects of the present disclosure is illustrated. For simplicity of illustration, the above-ground aspects of the drilling rig 100 have been omitted in FIG. 3. As illustrated, the drill pipe 165 of the drill string 155 extends into the wellbore 160. Element 302 illustrates that some distance may exist between regions of the wellbore 160 that have been cut out for purposes of illustration herein.

FIG. 3 illustrates the drill string 155 extending through several different formation types within a subsurface region; region A as illustrated is characterized by the wellbore 160 being lined with casing 166, corresponding to a stable wellbore environment. In such an environment, the trip speed may be higher than would be appropriate for a less stable environment, such as open hole portions where the surrounding geological formation is weaker. Region B as illustrated is characterized by the wellbore 160 being open hole 167 (lacking casing 166), passing through a formation 304. Formation 304 may be relatively stable or unstable, depending upon the strength of the formation and its permeability. As an example, formation 304 may be relatively unstable/weak as compared to other formation types, such as formation 306 and/or casing 166. Region C as illustrated is characterized by the wellbore 160 being open hole 167 (lacking casing 166), passing through a formation 306. Formation 306 may be relatively stable or unstable, depending upon the strength of the formation and its permeability. As an example, formation 306 may be relatively stable/strong as compared to other formation types, such as formation 304 and/or casing 166.

According to embodiments of the present disclosure, the control system 195 as described in FIGS. 1 and 2 may be used to modulate the trip speed according to the geological formation and casing status of the region through which the BHA 170 is then traversing. This is illustrated graphically in FIGS. 4A-4C and 5A-5B below for surge and swab operations, respectively.

Figure 4A:
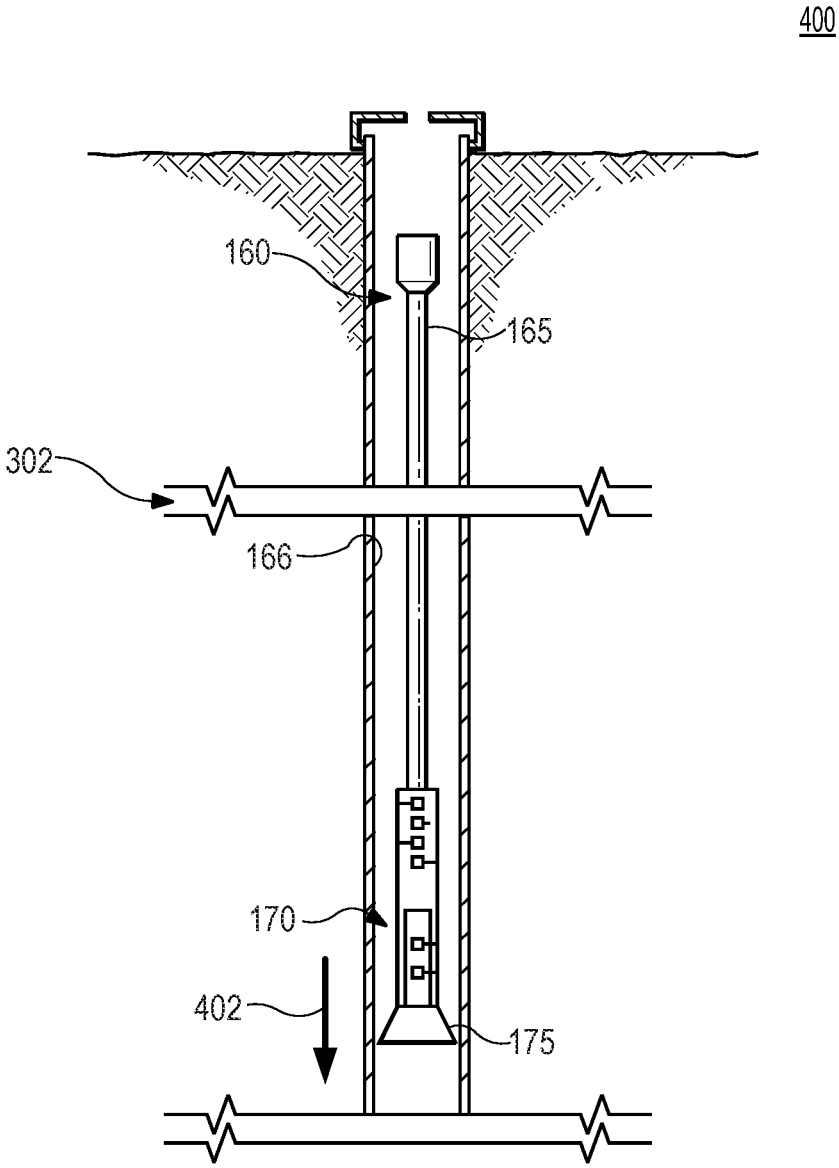
FIG. 4A is a cross-section view of operation of the wellbore protection control system in an exemplary wellbore environment during a surge operation according to one or more aspects of the present disclosure.

FIG. 4A is a cross-section view 400 of operation of the wellbore protection control system in an exemplary wellbore environment during a surge operation according to one or more aspects of the present disclosure. As illustrated in FIG. 4, the surge operation is lowering the BHA 170 down 402 into the wellbore 160.

In FIG. 4A, the BHA 170 is traversing a region that includes casing 166. Therefore, the controller 195 may automatically increase the trip speed up to the maximum trip speed calculated as appropriate in the casing 166, for example as discussed with respect to FIG. 2 above (e.g., as predetermined according to the well plan, pressure and fracture gradients, and tracked location from tracking tubulars and their corresponding lengths). This maximum trip speed while in the casing 166 is identified as the first trip speed for this discussion. The controller 195 may do so according to a predetermined value, dynamically in response to a combination of the depth knowledge and surrounding pressure measurements in the wellbore, or some combination of the two.

Figure 4B:
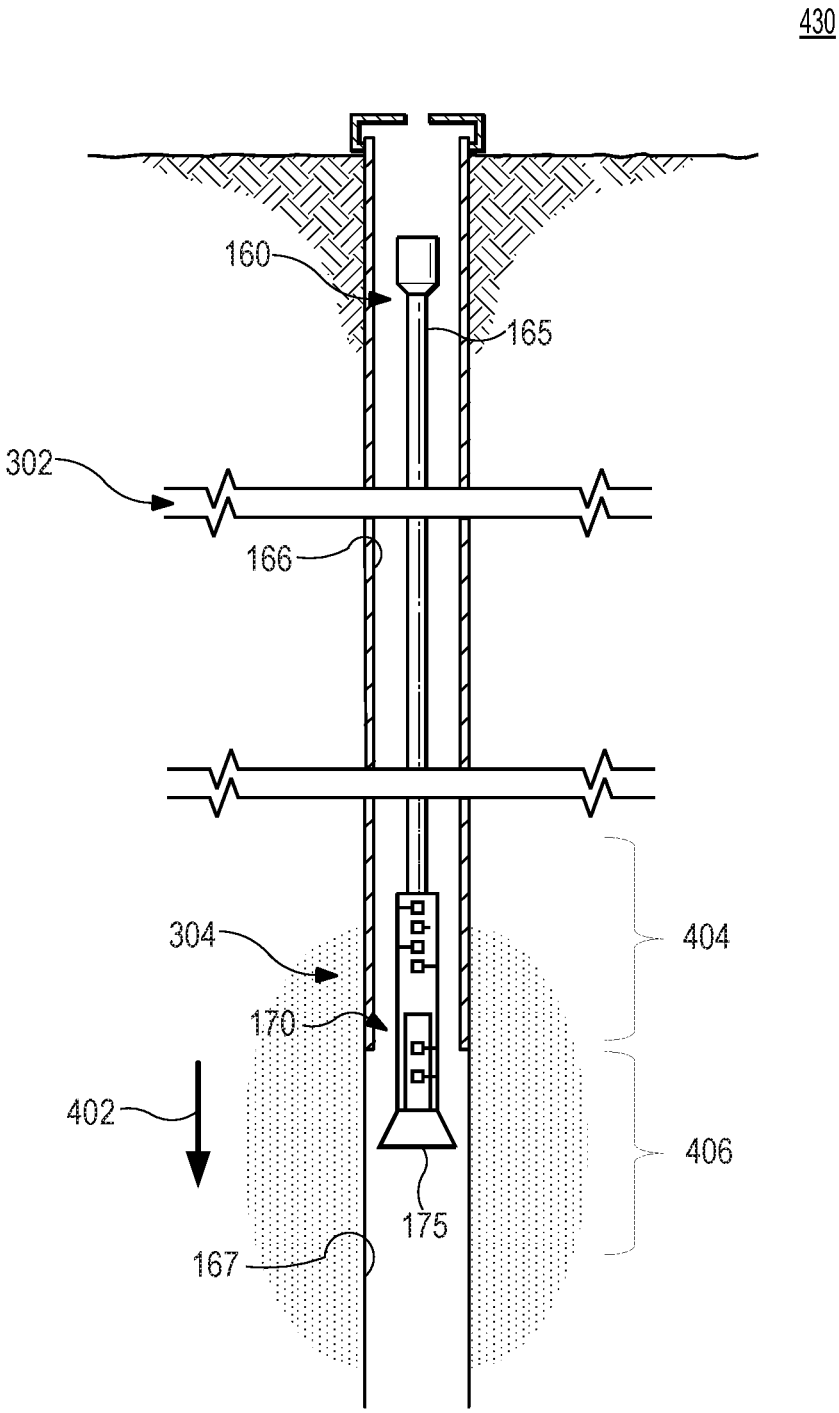
FIG. 4B is a cross-section view of operation of the wellbore protection control system in an exemplary wellbore environment during a surge operation according to one or more aspects of the present disclosure.

Turning now to FIG. 4B, illustrated is a cross-section view 430 of operation of the wellbore protection control system in an exemplary wellbore environment during a surge operation according to one or more aspects of the present disclosure. In particular, view 430 illustrates a transition as the surge operation causes the BHA 170 to pass from the region 404 lined with casing 166 to the region 406 characterized as the open hole 167.

The control system 195 identifies this transition as occurring and modulates the trip speed to a second trip speed that is less than or equal to the maximum trip speed appropriate for the geological formation 304 through which the BHA 170 is now traversing. For example, the formation 304 may be relatively unstable as compared to the stability in the casing 166, and therefore the second trip speed is less than the first trip speed. The second trip speed may be determined beforehand according to the well plan and asset tracking of the tubulars, and/or according to dynamic pressure measurements from the BHA 170 as they are received at the control system 195.

Figure 4C:
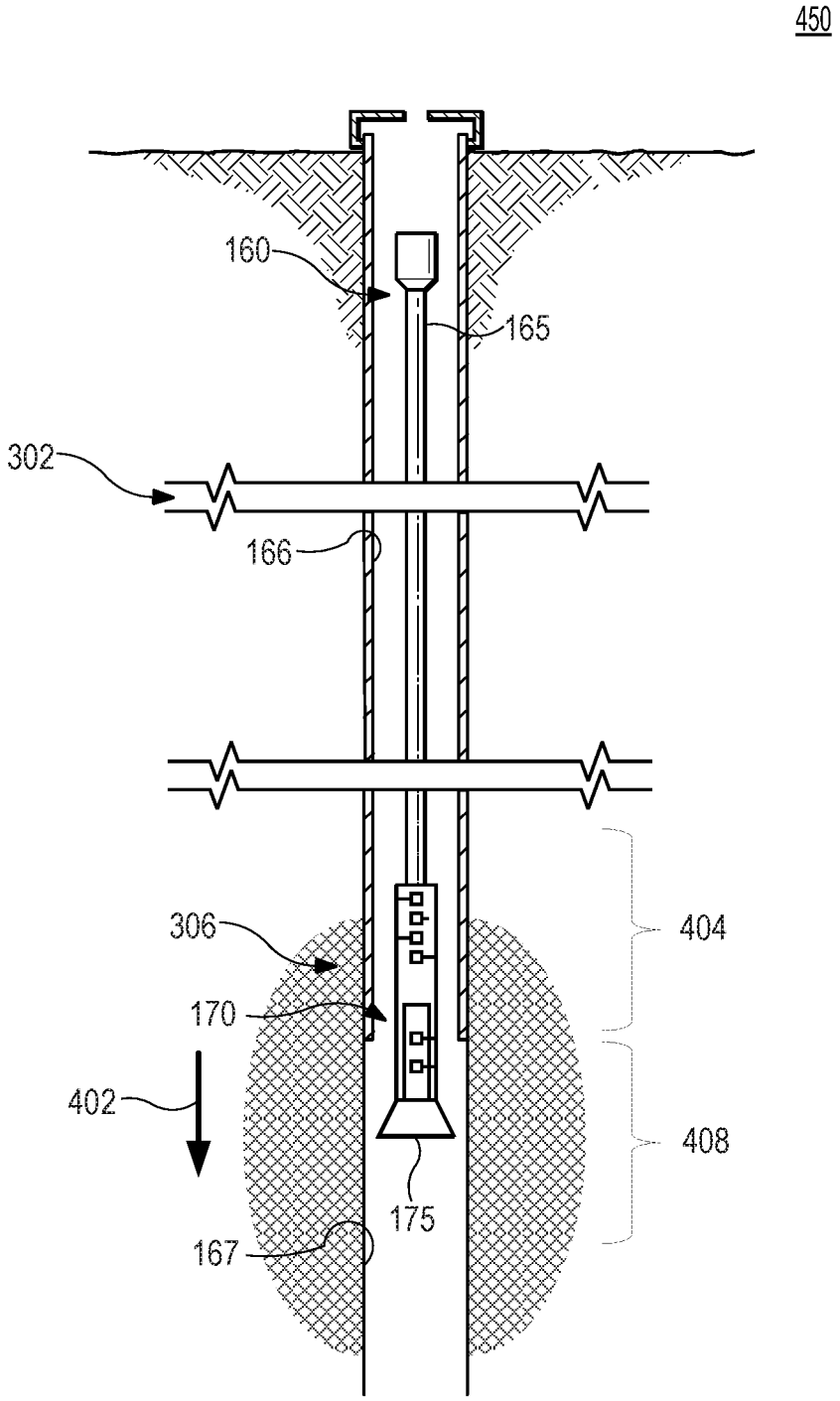
FIG. 4C is a cross-section view of operation of the wellbore protection control system in an exemplary wellbore environment during a surge operation according to one or more aspects of the present disclosure.

FIG. 4C is a cross-section view 450 of operation of the wellbore protection control system in an exemplary wellbore environment during a surge operation according to one or more aspects of the present disclosure. As illustrated in FIG. 4C, view 450 illustrates a transition as the surge operation causes the BHA 170 to pass from the region 404 lined with casing 166 to the region 408 characterized as the open hole 167.

The control system 195 identifies this transition as occurring and modulates the trip speed to a third trip speed that is less than or equal to the maximum trip speed appropriate for the geological formation 306 through which the BHA 170 is now traversing. For example, the formation 306 may be relatively stable as compared to the stability of the formation 304 of FIG. 4B and/or in the casing 166, and therefore the third trip speed is greater than the second trip speed, and may be greater than the first trip speed or less than, depending on the stability of the formation 306 relative to the casing 166. The third trip speed may be determined beforehand according to the well plan and asset tracking of the tubulars, and/or according to dynamic pressure measurements from the BHA 170 as they are received at the control system 195.

Although illustrated as transitioning from the region 404 characterized by the casing 166 in FIG. 4C, or in FIG. 4B, it will be recognized that the transition during the surge down 402 into the wellbore 160 may be between any of the formation types, for example transitioning from the casing 166 region to either of the formations 304/306 and then from either of the formations 304/306 to another formation of the same or different type. Although two formations are illustrated, it will be recognized that a wellbore may traverse any number of formations with different relative properties to each other, as may be identified in the well plan and (in some embodiments) verified during initial drilling by the x-ray sensor of the BHA 170.

Thus, according to embodiments of the present disclosure, during a surge operation the control system 195 modulates automatically the trip speed as the depth of the drill bit 175 traverses between formation types, as predicted, measured, and/or sensed during the surge.

The control system 195 as described in FIGS. 1 and 2 may also be used to modulate the trip speed according to the geological formation and casing status of the region through which the BHA 170 is then traversing in a swab operation. This is illustrated graphically in FIG. 5A, which is a cross-section view 500 of operation of the wellbore protection control system in an exemplary wellbore environment during a swab operation according to one or more aspects of the present disclosure.

Figure 5A:
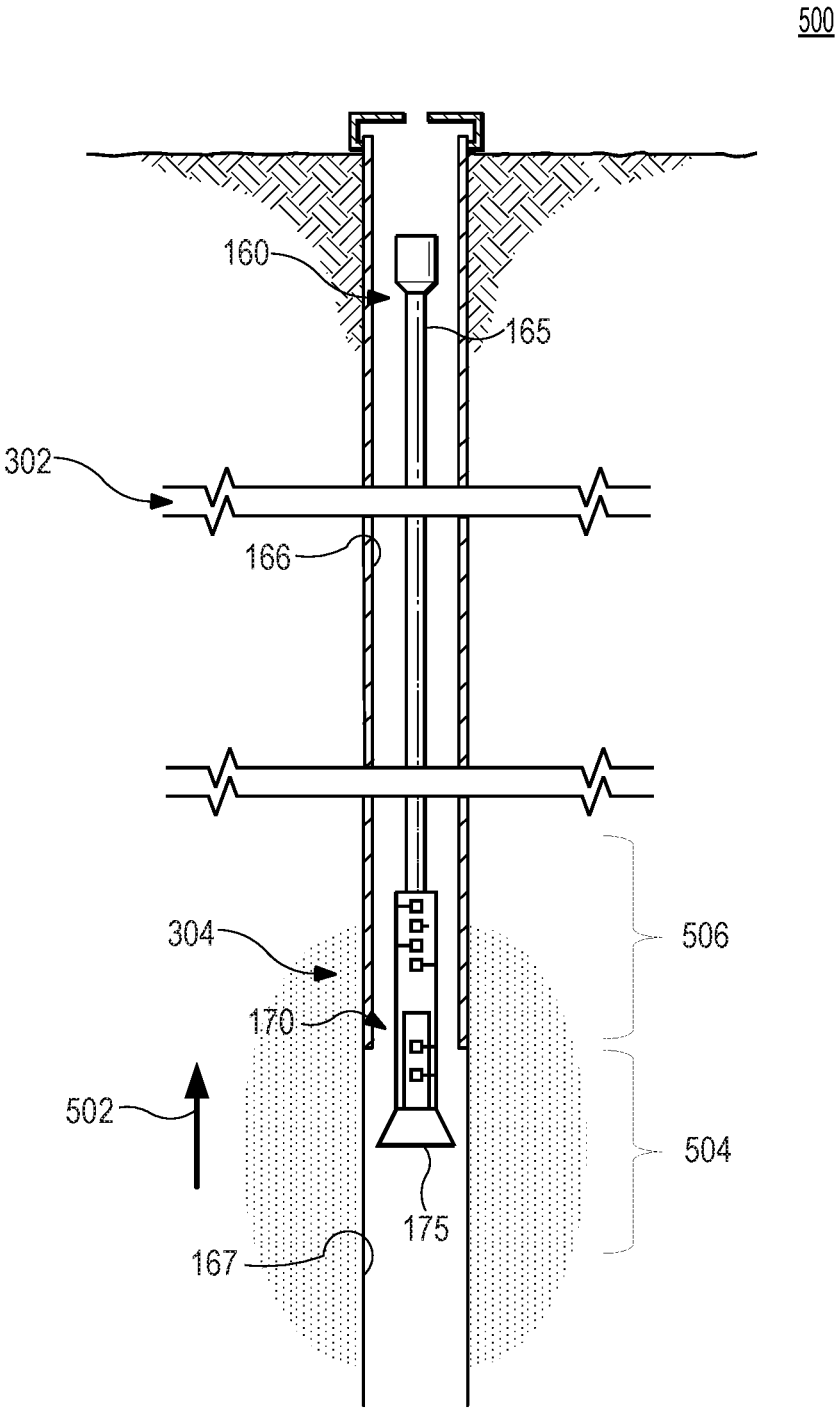
FIG. 5A is a cross-section view of operation of the wellbore protection control system in an exemplary wellbore environment during a swab operation according to one or more aspects of the present disclosure.

As illustrated in FIG. 5A, the drill string 155 is being hoisted 502 back to the surface. The BHA 170 is transitioning from a region 504 characterized as an open hole 167 within a formation 304 to a region 506 lined with casing 166. As an example, the formation 304 may be relatively unstable as compared to formation 306, e.g. less stable than the casing 166. Therefore, as the control system 195 determines that the transition between regions 504 and 506 is occurring (e.g., based on the well plan, pressure and fracture gradients, and tracked location from tracking tubulars and their corresponding lengths, and/or pressure measurements), it causes the trip speed for the swab to increase, e.g. from a first trip speed that is less than or equal to the maximum swab speed appropriate for the formation 304 to a second trip speed that is less than or equal to the maximum swab speed appropriate for the casing 166, which is greater than the first trip speed.

Thus, when the BHA 170 reaches the casing 166, the control system 195 may cause the trip speed to increase, therefore improving the efficiency of the overall drilling rig operations. The controller 195 may do so according to a predetermined value, dynamically in response to a combination of the depth knowledge and surrounding pressure measurements in the wellbore, or some combination of the two.

Figure 5B:
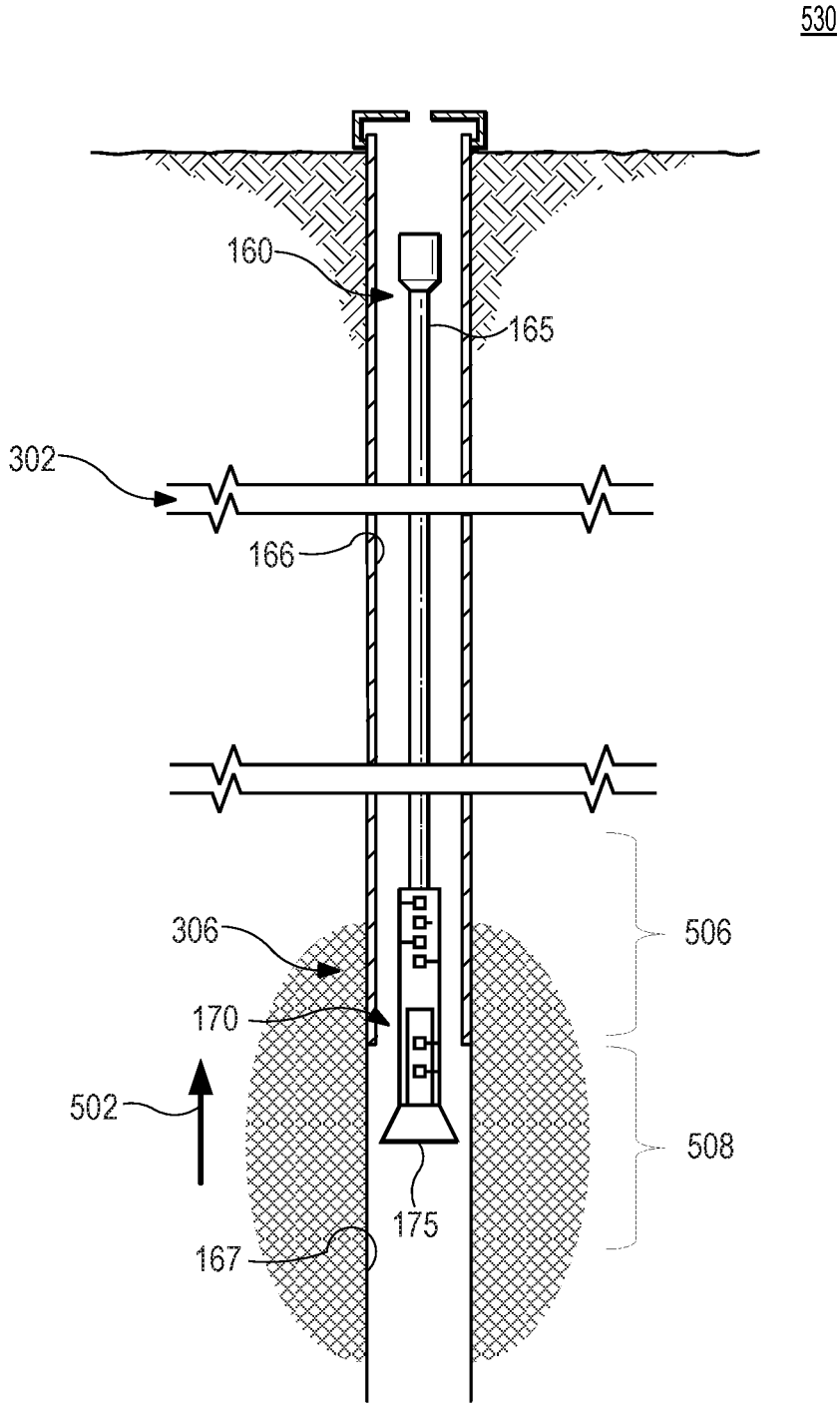
FIG. 5B is a cross-section view of operation of the wellbore protection control system in an exemplary wellbore environment during a swab operation according to one or more aspects of the present disclosure.

Turning now to FIG. 5B, as the drill string 155 is being hoisted 502 to the surface, the BHA 170 transitions from a region 508 characterized as an open hole 167 within a formation 306 to a region 506 lined with casing 166. As an example, the formation 306 may be relatively stable as compared to formation 304, but less stable than the casing 166. Therefore, as the control system 195 determines that the transition between regions 508 and 506 is occurring (e.g., based on the well plan, pressure and fracture gradients, and tracked location from tracking tubulars and their corresponding lengths, and/or pressure measurements), it causes the trip speed for the swab to decrease or increase (depending on the relative stability of the formation 306 to that of casing 166; for this example, it is assumed that the casing 166 is still more stable than the formation 306, and therefore the trip speed increases), e.g. from a third trip speed that is less than or equal to the maximum swab speed appropriate for the formation 306 to the second trip speed that is less than or equal to the maximum swab speed appropriate for the casing 166.

Thus, when the BHA 170 reaches the casing 166, the control system 195 may again cause the trip speed to increase, therefore improving the efficiency of the overall drilling rig operations. The controller 195 may do so according to a predetermined value, dynamically in response to a combination of the depth knowledge and surrounding pressure measurements in the wellbore, or some combination of the two.

Although illustrated as transitioning from the regions 504 or 506 characterized by the open hole 167 to casing 166, it will be recognized that the transition during the swab hoist 502 out of the wellbore 160 may be between any of the formation types, for example transitioning from the formation 304 to the formation 306, or from the formation 304 to the formation 304, and then to the casing 166 region. Although two formations are illustrated, it will be recognized that a wellbore may traverse any number of formations with different relative properties to each other, as may be identified in the well plan and (in some embodiments) verified during initial drilling by the x-ray sensor of the BHA 170.

Thus, according to embodiments of the present disclosure, during a swab operation the control system 195 modulates automatically the trip speed as the depth of the drill bit 175 traverses between formation types, as predicted, measured, and/or sensed during the surge.

Figure 6:
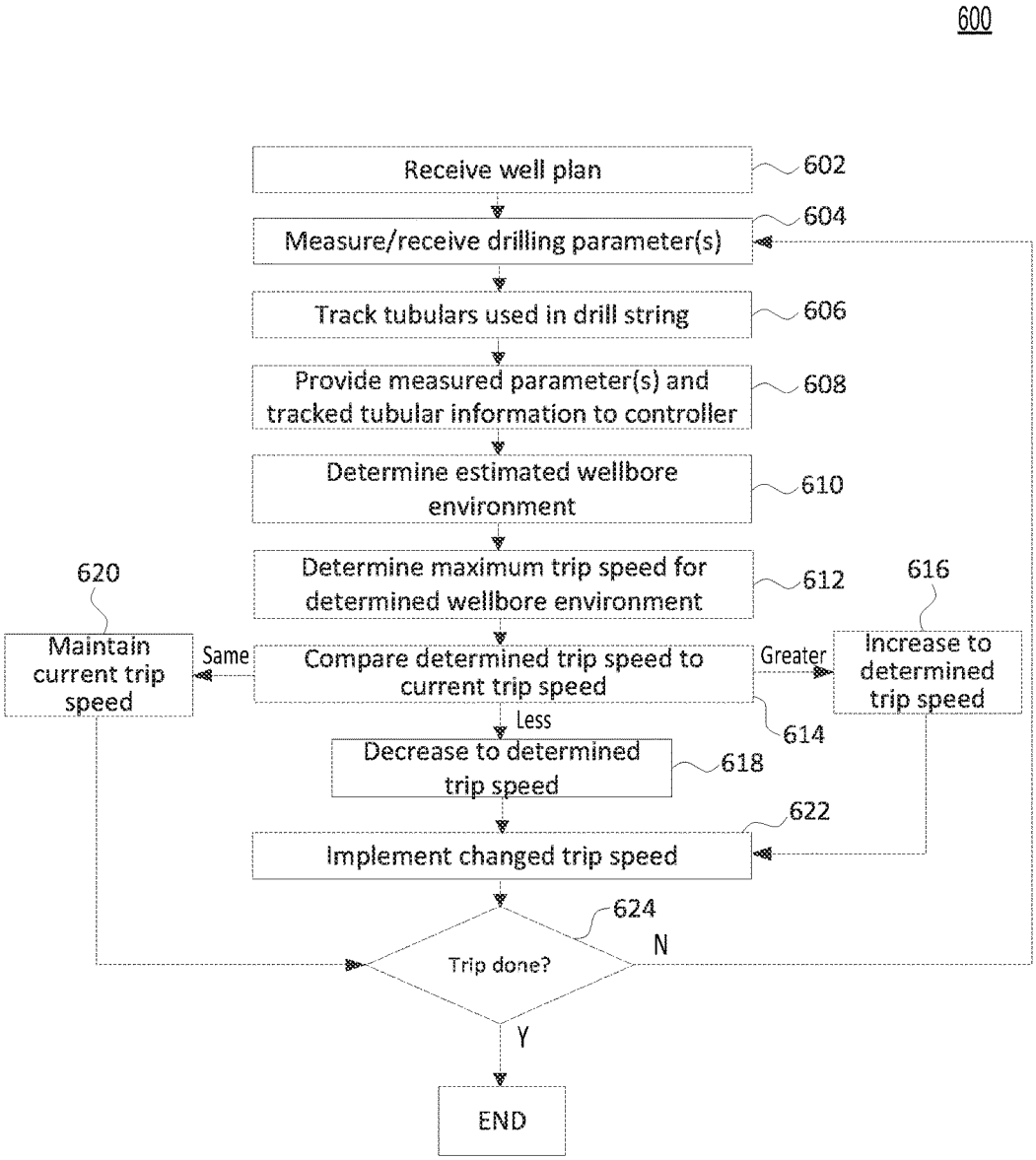
FIG. 6 is an exemplary flow chart showing an exemplary process for protecting a wellbore by controlling trip speed in a surge or swab operation according to aspects of the present disclosure.

FIG. 6 is an exemplary flow chart showing an exemplary process 600 for protecting a wellbore by controlling trip speed in a surge or swab operation according to aspects of the present disclosure. The process 600 may be performed, for example, with respect to the control system 195 and the drilling rig 100 components discussed above with respect to FIGS. 1-2. It is understood that additional steps can be provided before, during, and after the steps of method 600, and that some of the steps described can be replaced or eliminated from the method 600.

At block 602, the control system 195 receives the well plan for the wellbore 160. This may be received, for example, prior to commencement of drilling operations (i.e., before the wellbore 160 has been substantively started). The well plan may be received via the user interface 222 from a use locally entering the well plan. Alternatively, the well plan may be received via a wired or wireless connection from a remote entity via the transceiver 216.

At block 604, the drilling rig 100 measures parameters during drilling. For example, as the wellbore 160 is being drilled, the x-ray sensor on the BHA 170 may validate formation information in the wellbore as provided in the well plan received at block 602. The control system 195 may receive the data from the x-ray sensor and perform the validation and make any edits necessary to the well plan (or just store the data in another location with ready access). As another example, during a surge or a swab operation the control system 195 may receive pressure measurements from a pressure sensor at the BHA 170.

At block 606, which may occur at a same or nearly same time as block 604, the control system 195 may track the tubulars used in the drill string 155 as the wellbore 160 is drilled and/or as a surge or swab operation occurs. For example, when tubulars are made up into stands (e.g., 3 tubulars), this may be tracked, as well as when the tubular or the stand is attached to the end of the drill string 155 or removed therefrom. This may occur via scanning or other mechanism as each event occurs.

At block 608, the data collected from blocks 602, 604, and 606 are provided to the controller 210 of the control system 195. The control system 195 may update a database regarding the status change of each tubular.

At block 610, the control system 195 takes the information collected at block 608 and determines an estimated wellbore environment. In an embodiment, this may be performed during any point in the drilling operations, i.e. prior to any surge or swab operation occurring. For example, the control system 195 may extract data from the well plan regarding geological formations and their properties (whether estimated or validated), properties of the tubulars, properties of the drilling mud, and other parameters and calculate the pressure gradient, the fracture gradient, and therefrom laminar flow and/or turbulent flow. The control system 195 may identify the boundaries of each geological formation, including where casing 166 exists in the wellbore already. In another embodiment, the control system 195 may make the determinations on demand, for example when a swab or surge operation begins. In such instances, the control system 195 may access the same data as indicated above for a prior calculation and make the determination of the region that the BHA 170 is currently within and the next region it will reach.

At block 612, the control system 195 determines the maximum trip speed (e.g., the maximum surge speed in a surge operation and a maximum swab speed in a swab operation) that is possible without causing damage to the wellbore 160, e.g. in the open hole 167.

In an embodiment, the control system 195 may determine the maximum trip speed for both swab and surge operations prior to a surge or swab operation beginning. This may involve computing different maximum trip speeds for each region identified at block 610 and storing these speeds into a database for access when a surge or swab operation occurs.

Alternatively, the control system 195 may receive pressure information from a pressure sensor at the BHA 170 (e.g., as part of block 604) and use that, in combination with well plan data (either estimated or validated), and determine the instantaneous trip speed. This determination may repeat frequently enough (e.g., multiple times a second) so as to provide a real-time dynamic (and automatic, just as with the other type of determination) adjustment of trip speed according to changing pressure information from the current region in the wellbore 160, in addition to geological information from the well plan and the depth of the BHA 170 as derived from the tracked tubular information.

At block 614, the control system 195 compares the determined maximum trip speed to the current trip speed, where the surge or swab operation has already begun. If the determined maximum trip speed is greater than the current trip speed, then the method 600 proceeds to block 616.

At block 616, the control system 195 causes the drawworks 130 to increase its speed of operation (hoisting for a swab operation and lowering for a surge operation) to the determined maximum trip speed.

Returning to block 614, if the determined maximum trip speed is less than the current trip speed, then the method 600 proceeds to block 618. At block 618, the control system 195 causes the drawworks 130 to decrease its speed of operation (hoisting or lowering) to the determined maximum speed.

In, instead, at block 614 it is determined that the determined maximum trip speed equals the current trip speed, then the method 600 proceeds to block 620, where the trip speed is maintained.

As an alternative for the operation of block 614 described above, the control system 195 may track the depth of the drill string 155 based on tracking the tubulars to determine when the BHA 170 is transitioning to another geological formation (and/or from open hole 167 to casing 166, or from casing 166 to open hole 167), and proceed to block 622 to implement the maximum trip speed for the new region that was either determined prior to the trip operation (surge or swab) or during the surge/swab operation.

From either block 616 or 618, the method 600 proceeds to block 622. At block 622, the determined maximum trip speed increase (block 616) or decrease (block 618) is implemented by the drawworks 130.

From block 622, as well as from block 620, the method 600 proceeds to decision block 624.

At decision block 624, the control system 195 determines whether the trip operation has completed or not (e.g., hoisting is done for a swab operation or lowering is done for a surge operation). If the trip operation is done, then the method 600 may end. If instead it is not done, the method 600 may return to block 604 to proceed as described above.

Accordingly, the control system 195 according to embodiments of the present disclosure is able to automatically determine a maximum trip speed that is responsive to the environment in which the BHA 170 is traversing, and which therefore may dynamically change as the environment changes. As a result, a hoisting or lowering speed of the drawworks is optimized to increase the efficiency while still preventing the unsafe conditions.

In view of all of the above and the figures, one of ordinary skill in the art will readily recognize that the present disclosure introduces a method, comprising: tracking, automatically by a controller of a drilling rig, a position of a bit at a distal end of a bottom hole assembly coupled to a drill string of the drilling rig in a wellbore during a surge or swab operation; determining, automatically by the controller, a current wellbore environment of the tracked position of the drill bit based on at least one received drilling parameter relating to the drill string in the wellbore; and adjusting, dynamically by the controller, a trip speed of the drill string based on the determined current wellbore environment.

The method may include wherein the adjusting further comprises: increasing the trip speed in response to determining that the current wellbore environment comprises a first wellbore condition; and decreasing the trip speed in response to determining that the current wellbore environment comprises a second wellbore condition that is different from the first wellbore condition, wherein the trip speed comprises a maximum speed of the drill string during the surge or swab operation in the current wellbore environment. The method may also include wherein: the first wellbore condition comprises at least one of a casing in the wellbore and a stable geological formation in the wellbore, and the second wellbore condition comprises an unstable geological formation in the wellbore. The method may also include wherein the drill string comprises at least one tubular, the tracking further comprising: receiving, by the controller, a tracked location of each tubular in the drill string as the drill string extends into the wellbore or is extracted out of the wellbore during the surge or swab operation, respectively, wherein the at least one drilling parameter comprises a depth of the bit at the distal end of the drill string determined by the controller based on the tracked location of each tubular in the drill string. The method may also include wherein: the receiving further comprises receiving, by the controller, a well plan of the wellbore, the well plan comprising geological formation information, casing information, and depth information, and the adjusting further comprises comparing one or more of the geological formation information, casing information, and depth information with the depth of the bit at the distal end of the drill string and computing the trip speed based on the comparison. The method may also include wherein: the at least one drilling parameter comprises a pressure sensed by a pressure sensor at the bit at the distal end of the drill string, the determining further comprises determining a friction gradient caused by the drill string in the wellbore during the surge or swab operation based on the sensed pressure, and the adjusting the trip speed is based on the determined friction gradient. The method may also include validating, by an x-ray sensor, geological formation information provided in a well plan during drilling operations; and setting, automatically by the controller, respective trip speeds and corresponding depth ranges associated with each validated geological formation, wherein the adjusting further comprises changing the trip speed to the respective trip speeds based on the tracked position of the bit reaching the corresponding depth ranges.

The present disclosure also includes a drilling rig apparatus comprising: a drill string comprising at least one tubular and a bottom hole assembly in a wellbore; a hoisting/lowering mechanism configured to lower the drill string into the wellbore in a surge operation and hoist the drill string out of the wellbore in a swab operation; and a well protection controller in communication with the hoisting/lowering mechanism and configured to receive at least one drilling parameter relating to the drill string in the wellbore, determine during the surge or the swab operation a trip speed of the drill string based on the at least one drilling parameter, and send the determined trip speed to the hoisting/lowering mechanism.

The drilling rig apparatus may include wherein the well protection controller is further configured, as part of the determination, to: increase the trip speed in response to a determination that a wellbore environment in which a distal end of the drill string is located comprises a first wellbore condition; and decrease the trip speed in response to a determination that the wellbore environment in which the distal end of the drill string is located comprises a second wellbore condition that is different from the first wellbore condition, wherein the trip speed comprises a maximum speed of the drill string during the surge or swab operation in a position in a wellbore environment determined from the at least one drilling parameter. The drilling rig apparatus may also include wherein: the first wellbore condition comprises at least one of a casing in the wellbore and a stable geological formation in the wellbore, and the second wellbore condition comprises a weak geological formation in the wellbore. The drilling rig apparatus may also include wherein the well protection controller is further configured to: receive a tracked location of each tubular in the drill string as the drill string surges into the wellbore or is swabbed out of the wellbore during the surge or swab operation, respectively, wherein the at least one drilling parameter comprises a depth of a distal end of the drill string determined by the well protection controller based on the tracked location of each tubular in the drill string. The drilling rig apparatus may also include wherein the well protection controller is further configured to: receive a well plan of the wellbore, the well plan comprising geological formation information, casing information, and depth information; receive formation information from an x-ray sensor coupled to the distal end of the drill string; validate the geological formation information with the received formation information from the x-ray sensor; and compare, as part of the determination, one or more of the validated geological formation information, casing information, and depth information with the depth of the distal end of the drill string. The drilling rig apparatus may also include wherein the well protection controller is further configured to: set a first trip speed for a first geological formation identified by the well plan and validated by the geological information for an identified first depth range; set a second trip speed for a second geological formation identified by the well plan and validated by the geological information for an identified second depth range; determine the trip speed based on the depth of the distal end of the drill string; adjust the trip speed by the hoisting/lowering mechanism to the first trip speed in response to the depth of the distal end of the drill string being within the first depth range; and adjust the trip speed by the hoisting/lowering mechanism to the second trip speed in response to the depth of the distal end of the drill string being within the second depth range. The drilling rig apparatus may also include wherein: the at least one drilling parameter comprises a pressure sensed by a pressure sensor at a distal end of the drill string and a depth of the distal end, the wellbore protection controller is further configured to determine a friction gradient of the drill string in the wellbore during the surge or swab operation based on the sensed pressure, and the trip speed is based on the determined friction gradient.

The present disclosure also includes a non-transitory machine-readable medium having stored thereon machine-readable instructions executable to cause a machine to perform operations comprising: receiving, automatically during a swab operation, at least one drilling parameter relating to a wellbore and a drill string of a drilling rig in the wellbore; determining, automatically during the swab operation, a swab speed of the drill string in the wellbore based on a position in a wellbore environment determined from the at least one drilling parameter; and updating, automatically during the swab operation, a rate of operation of a drilling rig component that hoists the drill string in the wellbore based on the determined swab speed.

The non-transitory machine-readable medium may include operations comprising: increasing the swab speed in response to determining that the wellbore environment in which a distal end of the drill string is located comprises a first wellbore condition; and decreasing the swab speed in response to determining that the wellbore environment in which the distal end of the drill string is located comprises a second wellbore condition that is different from the first wellbore condition. The non-transitory machine-readable medium may also include wherein: the first wellbore condition comprises at least one of a casing in the wellbore and a stable geological formation in the wellbore, and the second wellbore condition comprises a weak geological formation in the wellbore. The non-transitory machine-readable medium may also include operations comprising: receiving, automatically during a surge operation, the at least one drilling parameter relating to the wellbore; determining, automatically during the surge operation, a surge speed of the drill string in the wellbore based on the position in the wellbore environment determined from the at least one drilling parameter; and updating, automatically during the surge operation, a rate of operation of a drilling rig component that lowers the drill string in the wellbore based on the determined surge speed. The non-transitory machine-readable medium may also include operations comprising: receiving a tracked location of each tubular in the drill string as the drill string is hoisted out of the wellbore during the swab operation, wherein the at least one drilling parameter comprises a depth of a distal end of the drill string determined by the controller based on the tracked location of each tubular in the drill string. The non-transitory machine-readable medium may also include operations comprising: receiving a well plan of the wellbore, the well plan comprising geological formation information, casing information, and depth information; comparing one or more of the geological formation information, casing information, and depth information with the depth of the distal end of the drill string; and using a result of the comparison in determining the swab speed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

tracking, automatically by a controller of a drilling rig, a position of a bit at a distal end of a bottom hole assembly coupled to a drill string of the drilling rig during a surge or swab operation through a wellbore environment of a wellbore;

determining, automatically by the controller at a first time during the surge or swab operation, the wellbore environment comprises a first wellbore environment from the tracked position of the bit based on at least one received drilling parameter relating to the drill string in the wellbore;

adjusting, dynamically by the controller during the surge or swab operation, a trip speed of the drill string to a first trip speed based on the determined first wellbore environment;

determining, automatically by the controller at a second time during the surge or swab operation, the wellbore environment comprises a second wellbore environment from the tracked position of the bit based on the at least one received drilling parameter relating to the drill string in the wellbore; and adjusting, dynamically by the controller during the surge or swab operation, the trip speed of the drill string to a second trip speed based on the determined second wellbore environment.

2. The method of claim 1, wherein:

the wellbore environment comprises a geological formation, and the trip speed comprises a maximum speed of the drill string during the surge or swab operation in the wellbore environment.

3. The method of claim 2, wherein:

the first trip speed comprises an increase in speed in response to determining that the geological formation comprises at least one of a casing in the wellbore and a stable geological formation in the wellbore, and the second trip speed comprises a decrease in speed in response to determining that the geological formation comprises an unstable geological formation in the wellbore.

4. The method of claim 1, wherein the drill string comprises at least one tubular, the tracking further comprising:

receiving, by the controller, a tracked location of each tubular in the drill string as the drill string extends into the wellbore or is extracted out of the wellbore during the surge or swab operation, respectively, wherein the at least one drilling parameter comprises a depth of the bit at the distal end of the drill string determined by the controller based on the tracked location of each tubular in the drill string.

5. The method of claim 4, wherein:

the receiving further comprises receiving, by the controller, a well plan of the wellbore, the well plan comprising geological formation information, casing information, and depth information, and the adjusting further comprises comparing one or more of the geological formation information, casing information, and depth information with the depth of the bit at the distal end of the drill string and computing the trip speed based on the comparison.

6. The method of claim 1, wherein:

the at least one drilling parameter comprises a pressure sensed by a pressure sensor at the bit at the distal end of the drill string, the method further comprises determining a friction gradient caused by the drill string in the wellbore during the surge or swab operation based on the sensed pressure, and the adjusting to the first or the second trip speed is based on the determined friction gradient.

7. The method of claim 1, further comprising:

validating, by an x-ray sensor, geological formation information provided in a well plan during drilling operations; and setting, automatically by the controller, respective trip speeds and corresponding depth ranges associated with each validated geological formation, wherein the adjusting to the first or the second trip speed further comprises changing the first or the second trip speed to the respective trip speeds based on the tracked position of the bit reaching the corresponding depth ranges.

8. A drilling rig apparatus comprising:

a drill string comprising at least one tubular and a bottom hole assembly in a wellbore;

a hoisting/lowering mechanism configured to lower the drill string into the wellbore in a surge operation and hoist the drill string out of the wellbore in a swab operation; and a well protection controller in communication with the hoisting/lowering mechanism and configured to:

receive, during the surge or the swab operation, at least one drilling parameter relating to the drill string in the wellbore, determine, at a first time during the surge or the swab operation, a first trip speed of the drill string based on the at least one drilling parameter in a first wellbore environment of the wellbore, send, at the first time during the surge or the swab operation, the determined first trip speed to the hoisting/lowering mechanism, determine, at a second time during the surge or the swab operation, a second trip speed of the drill string based on the at least one drilling parameter in a second wellbore environment of the wellbore, and send, at the second time during the surge or the swab operation, the determined second trip speed to the hoisting/lowering mechanism.

9. The drilling rig apparatus of claim 8, wherein the first wellbore environment comprises a first geological formation and the second wellbore environment comprises a second geological formation, and the first or the second trip speed comprises a maximum speed of the drill string during the surge or swab operation in the wellbore.

10. The drilling rig apparatus of claim 9, wherein:

the first trip speed comprises an increase in speed in response to determining that the first geological formation comprises at least one of a casing in the wellbore and a stable geological formation in the wellbore, and the second trip speed comprises a decrease in speed in response to determining that the second geological formation comprises a weak geological formation in the wellbore.

11. The drilling rig apparatus of claim 8, wherein the well protection controller is further configured to:

receive a tracked location of each tubular in the drill string as the drill string surges into the wellbore or is swabbed out of the wellbore during the surge or swab operation, respectively, wherein the at least one drilling parameter comprises a depth of a distal end of the drill string determined by the well protection controller based on the tracked location of each tubular in the drill string.

12. The drilling rig apparatus of claim 11, wherein the well protection controller is further configured to:

receive a well plan of the wellbore, the well plan comprising geological formation information, casing information, and depth information;

receive formation information from an x-ray sensor coupled to the distal end of the drill string;

validate the geological formation information with the received formation information from the x-ray sensor; and compare, as part of the determining the first trip speed and the second trip speed, one or more of the validated geological formation information, casing information, and depth information with the depth of the distal end of the drill string.

13. The drilling rig apparatus of claim 12, wherein the well protection controller is further configured to:

set a first trip speed value for a first geological formation identified by the well plan and validated by the geological formation information for an identified first depth range;

set a second trip speed value for a second geological formation identified by the well plan and validated by the geological formation information for an identified second depth range;

adjust, during the surge or the swab operation, the first trip speed to the first trip speed value in response to the depth of the distal end of the drill string being within the first depth range for the first wellbore environment; and adjust during the surge or the swab operation the second trip speed to the second trip speed value in response to the depth of the distal end of the drill string being within the second depth range for the second wellbore environment.

14. The drilling rig apparatus of claim 8, wherein:

the at least one drilling parameter comprises a pressure sensed by a pressure sensor at a distal end of the drill string and a depth of the distal end, the well protection controller is further configured to determine a friction gradient of the drill string in the wellbore during the surge or swab operation based on the sensed pressure, and the first trip speed or the second trip speed is based on the determined friction gradient.

15. A non-transitory machine-readable medium having stored thereon machine-readable instructions executable to cause a machine to perform operations comprising:

receiving, automatically during a swab operation, at least one drilling parameter relating to a wellbore and a drill string of a drilling rig in the wellbore;

determining, automatically at a first time during the swab operation, a first swab speed of the drill string in the wellbore based on a first position in a wellbore environment determined from the at least one drilling parameter;

updating, automatically at the first time during the swab operation, a rate of operation of a drilling rig component that hoists the drill string in the wellbore based on the first determined swab speed;

determining, automatically at a second time during the swab operation, a second swab speed of the drill string in the wellbore based on a second position in the wellbore environment determined from the at least one drilling parameter; and updating, automatically at the second time during the swab operation, the rate of operation of the drilling rig component that hoists the drill string in the wellbore based on the second determined swab speed.

16. The non-transitory machine-readable medium of claim 15, wherein:

the first swab speed comprises an increase in the rate of operation in response to determining that the first wellbore environment in which a distal end of the drill string is located comprises a first wellbore condition; and the second swab speed comprises a decrease in the rate of operation in response to determining that the second wellbore environment in which the distal end of the drill string is located comprises a second wellbore condition that is different from the first wellbore condition.

17. The non-transitory machine-readable medium of claim 16, wherein:

the first wellbore condition comprises at least one of a casing in the wellbore and a stable geological formation in the wellbore, and the second wellbore condition comprises a weak geological formation in the wellbore.

18. The non-transitory machine-readable medium of claim 15, the operations further comprising:

receiving, automatically during a surge operation, the at least one drilling parameter relating to the wellbore;

determining, automatically at a first time during the surge operation, a first surge speed of the drill string in the wellbore based on the first position in the first wellbore environment determined from the at least one drilling parameter;

updating, automatically at the first time during the surge operation, a rate of operation of the drilling rig component based on the first determined surge speed;

determining, automatically at a second time during the surge operation, a second surge speed of the drill string in the wellbore based on the second position in the second wellbore environment determined from the at least one drilling parameter; and updating, automatically at the second time during the surge operation, the rate of operation of the drilling rig component that lowers the drill string in the wellbore based on the second determined surge speed.

19. The non-transitory machine-readable medium of claim 15, wherein the drill string comprises at least one tubular, the operations further comprising:

receiving a tracked location of each tubular in the drill string as the drill string is hoisted out of the wellbore during the swab operation, wherein the at least one drilling parameter comprises a depth of a distal end of the drill string determined by the machine based on the tracked location of each tubular in the drill string.

20. The non-transitory machine-readable medium of claim 15, the operations further comprising:

receiving a well plan of the wellbore, the well plan comprising geological formation information, casing information, and depth information;

comparing one or more of the geological formation information, casing information, and depth information with the depth of a distal end of the drill string; and using a result of the comparison in determining a swab speed.

* * * * *